US005402895A

United States Patent [19]

Mikkelsen et al.

[11] Patent Number: 5,402,895

[45] Date of Patent: Apr. 4, 1995

[54] MAGNETIC FACING SYSTEM

[75] Inventors: John M. Mikkelsen, Philadelphia; Thomas C. Gross, Lansdowne, both of Pa.

[73] Assignee: Brandt, Inc., Bensalem, Pa.

[21] Appl. No.: 127,696

[22] Filed: Sep. 28, 1993

[51] Int. Cl.[6] ..... B07C 5/00

[52] U.S. Cl. ..... 209/534; 209/567

[58] Field of Search ..... 209/534, 567, 569

[56] References Cited

U.S. PATENT DOCUMENTS

| | | | |
|---|---|---|---|
| 3,004,110 | 10/1961 | Schutze et al. | 179/100.2 |
| 3,157,868 | 11/1964 | Buslik | 340/174.1 |
| 3,499,998 | 3/1970 | Tanigawa et al. | 179/100.2 |
| 3,715,031 | 2/1973 | Okkonen | 209/75 |
| 3,966,047 | 6/1976 | Steiner | 209/75 |
| 4,557,597 | 10/1985 | Iwama | 209/534 |
| 4,584,529 | 4/1986 | Aoyama | 209/534 |
| 4,678,072 | 7/1987 | Kobayashi | 194/206 |
| 4,690,268 | 9/1987 | Ueshin | 209/534 |
| 4,880,096 | 11/1989 | Kobayashi et al. | 194/206 |
| 5,186,334 | 2/1993 | Fukudome et al. | 209/534 |

*Primary Examiner*—Kenneth W. Noland

*Attorney, Agent, or Firm*—Shenier & O'Connor

[57] ABSTRACT

A system for facing currency notes of a stack of notes, each of which is printed with magnetic ink on only the face thereof in which notes from the stack are moved one by one along a path past an examining location at which magnetic heads examine the respective sides of a note for the presence of magnetic material to produce first and second signals which are integrated over the period of time for which a note is at the location. The integrated first and second signals are compared to produce a facing signal which directs the notes to one or the other of two output trays in accordance with the disposition of the note faces toward one or the other of the path sides.

17 Claims, 4 Drawing Sheets

MAGNETIC FACING SYSTEM

FIELD OF THE INVENTION

The invention is in the field of currency note handling devices and more particularly relates to a system for arranging a plurality of notes face up.

BACKGROUND OF THE INVENTION

There are known in the prior art many devices for testing currency notes for various characteristics such as genuineness, for example. These devices generally require that the notes of a plurality of notes being tested be arranged so that they are fed past the testing device, all with the same side up.

As is also known in the art, U.S. currency notes, for example, have the faces or portrait sides printed with ink having magnetic properties. This characteristic is made use of in many testing devices for determining the genuineness of currency notes.

SUMMARY OF THE INVENTION

One object of our invention is to provide a system for arranging all of the notes of a plurality with the same side up.

Another object of our invention is to provide a currency note facing system which is simple in construction and in operation.

A further object of our invention is to provide a currency note facing system which is reliable.

Yet another object of our invention is to provide a currency note facing system which simultaneously tests the magnetic characteristics of both sides of a note under test.

A still further object of our invention is to provide a currency note facing system in which notes fed to the testing area face up are directed to a first output tray and in which other notes fed to the testing area face down are directed to a second output tray.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
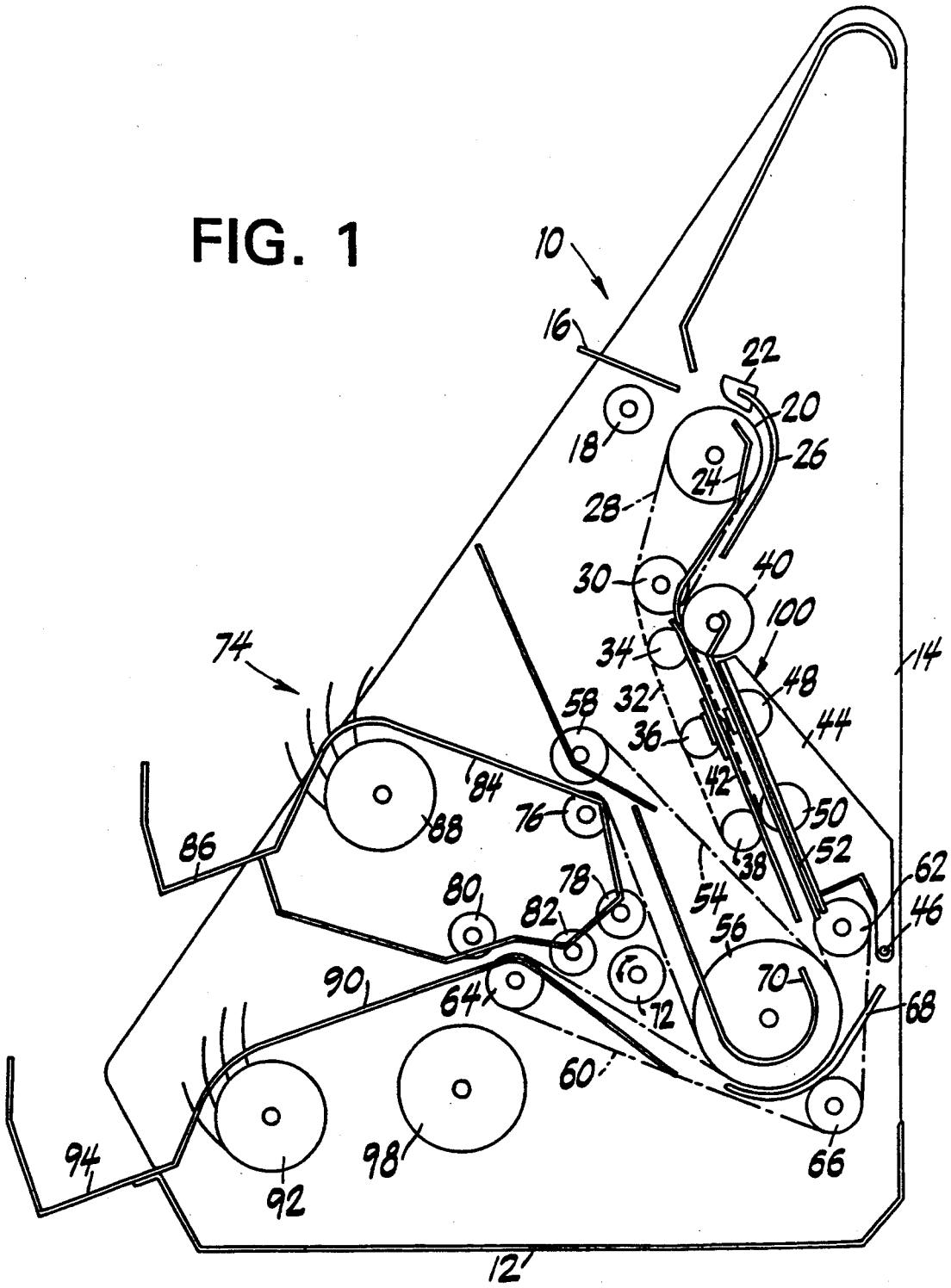
FIG. 1 is a partially schematic sectional view of the note transport apparatus of our magnetic facing system.

Referring now to FIG. 1, the note transport apparatus indicated generally by the reference character 10 of our magnetic facing system includes a base 12 and a pair of side panels, one panel 14 of which is shown in FIG. 1. The side panels support an input tray 16 adapted to receive a stack of notes to be faced. A picker roll 18 is actuated to advance the lowermost note in the stack on tray 16 toward feed rolls, one roll 20 of which is illustrated in FIG. 1. Strippers 22 cooperate with feed rolls 20 to ensure that only one note at a time is advanced along the feed path between a pair of guides 24 and 26.

Figure 2:
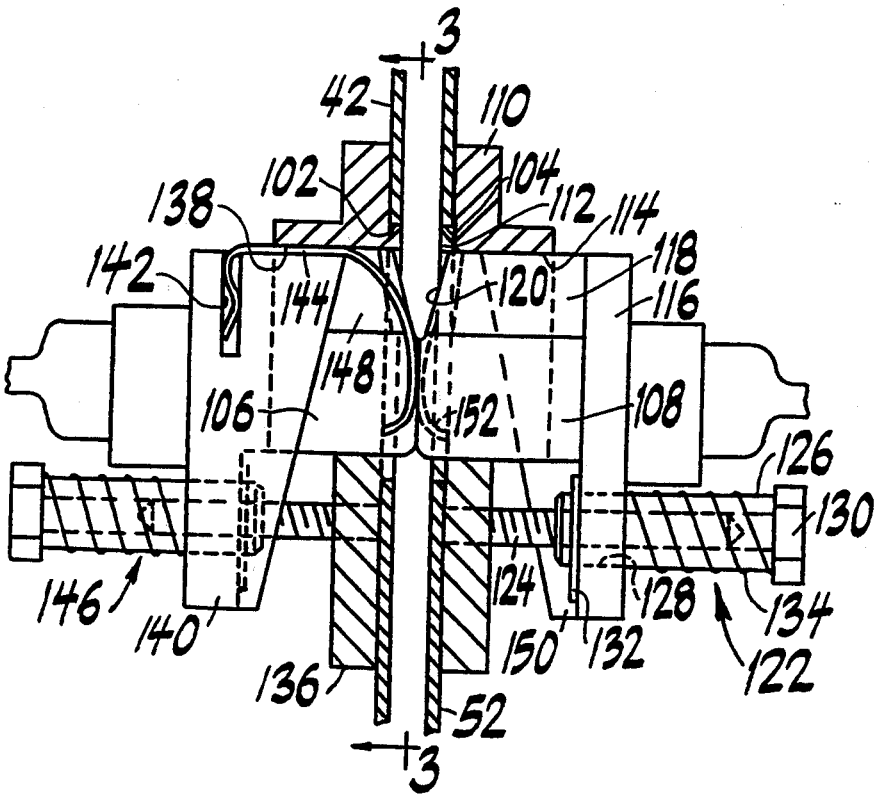
FIG. 2 is a fragmentary sectional view of the apparatus illustrated in FIG. 1 drawn on an enlarged scale to show the details of the sensing arrangement of our magnetic facing system.

Accelerating belts driven by accelerating rollers, one belt 28 and its associated roller 30 of which are shown in FIG. 2, extend around accelerating idlers (not shown) carried by the shaft supporting roll 20, to advance the notes one at a time to second belts 32 extending around rollers 34, 36 and 38 and over a lower guide plate 42.

Pinch rolls 40 form nips with the belts 32 at the location of rollers 34.

A frame 44 pivotally mounted on pins 46 carries rollers 48 and 50 adapted to engage the belts 32 at the locations of rollers 36 and 38 when frame 44 is in the closed position. An upper guide plate 52 on the frame 44 has an extension which locks rollers: 44 in their nip-forming positions when the frame is closed. It will readily be appreciated that the frame 44, together with rollers 48 and 50 and upper guide 52, can be swung away from the belts 32 to provide access to the note path.

Our note handling apparatus includes upper bill separating belts 54 extending around large diameter pulleys 56 and return pulleys 58.

Lower bill separating belts 60 extend from rollers 62 and partially a round rollers 56 in register with the belts 54 and then to return rollers 64 and 66.

From the structure just described, it will be appreciated that currency notes emerging from the space between guide plates 42 and 52 are received between belts 54 and 60 and carried around rollers; 56 between guides 68 and 70 to a location at which the belts 54 and 60 diverge. As notes emerge from between the belts 54 and 60 at the location at which the belts diverge, they encounter a gating roller 72, the rotation of which is controlled in a manner to be described hereinbelow to direct the note, either in the direction of belts 54 or in the direction of belts 60.

Our note handling apparatus includes a movable section indicated generally by the reference number 74. The unit 74 supports a pair of upper pinch rolls 76 and 78 and a pair of lower pinch rolls 80 and 82. The unit 74 has a guide portion 84 leading to the upper output tray 86. Further, the unit 74 supports the upper stacker wheel 88.

The structure thus far described is shown and described in detail in copending application Ser. No. 08/073,731 filed Jun. 8, 1993, the showing of which is incorporated herein by reference. As is pointed out more fully in the copending application, the unit 74 is adapted to be moved from an operative position at which the paper paths are complete to an inoperative position at which the region of the gating roller is accessible.

In the operative position of the unit 74, the upper pinch rollers 76 and 78 engage belts 54 while the lower pinch rollers 80 and 82 engage belts 60. In this condition of the parts, a note directed toward belts 54 by the gating roller 72 moves upwardly between pinch roll 78 and belts 54 and between pinch rolls 76 and belts 54 and outwardly over guide 84 to the upper stacker wheel 88 which delivers the notes to the upper tray 86. A note directed by gating roller 72 in the direction of belts 60 passes between rollers 82 and belts 60 and between rollers 80 and belts 60 to a guide which directs the notes toward the lower stacker wheel 92 which delivers the notes to the lower output tray 94.

The note handling apparatus of our casing system includes a drive motor 98. The relationship between the drive motor and the various elements of the note handling apparatus are described in detail in the copending application referred to hereinabove.

Figure 3:
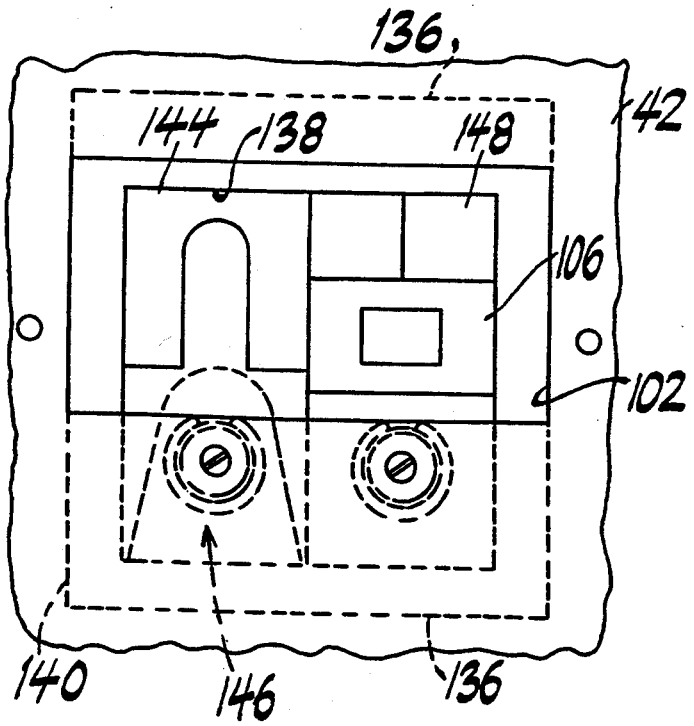
FIG. 3 is a sectional view taken along the line 3—3 of FIG. 2.
Figure 4:
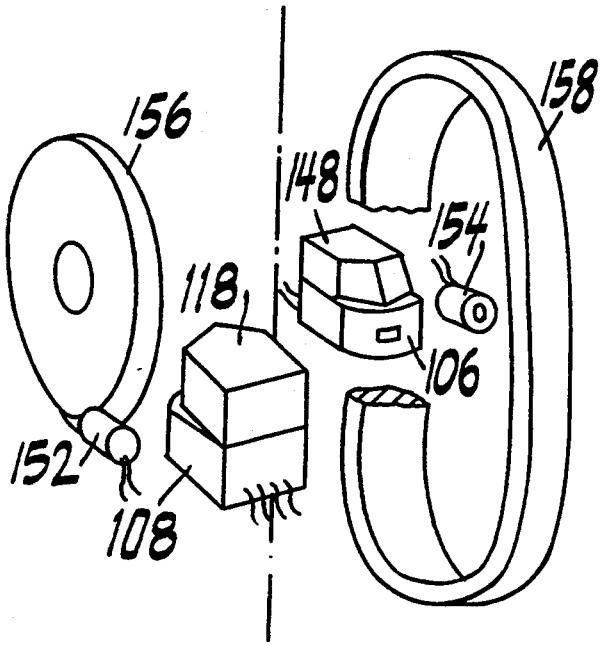
FIG. 4 is an exploded view with a part broken away and with other parts removed illustrating alternate embodiments of our magnetic facing system.

We arrange our facing sensors at the location indicated generally by the reference character 100 of the rollers 36 and 48. Referring now to FIGS. 2 and 3, the plates 42 and 52 are provided with respective windows 102 and 104 at the location 100. Our sensors include a front magnetic head 106 and a rear magnetic head 108. A rear mounting block 110 has a boss 112 which fits into the window 104. The rear mounting block 110 has an opening 114 in which the rear head 108 is disposed in a manner to be described hereinbelow.

We mount the rear head 108 on a support plate 116 together with a note guide 118 having an inclined knife edge 120 which the note encounters as it moves downwardly between the plates 42 and 52 as viewed in FIG. 2.

We provide a mechanism indicated generally by the reference character 122 for regulating the force with which plate 116 is urged to the left as viewed in FIG. 2, so as to move the guide 118 and the head 108 into the opening 114. The adjusting mechanism 122 includes a screw 124 carried by the plate 52 and the rear mounting block 110. Screw 124 receives an internally threaded sleeve 126 slideable in a bore 128 in the rear head mounting plate 116, Sleeve 126 has a head 130 which facilitates turning of the sleeve 126 on the screw 124. A snap ring 132 received in a groove in the outer surface of sleeve 126 retains the sleeve in assembled relationship with the plate 116. A spring 134 bears between the head 130 and the plate 116.

From the structure thus far described, it will readily be appreciated that when the sleeve 126 is turned down on the screw 124, the force exerted by spring 134 tends to move head 108 and guide 118 further into the opening 114 in the block 110.

Our assembly includes a front mounting block 136 provided with a boss similar to the boss 112 on block 110. This front mounting block boss is received in the window 102 in plate 42. We provide the front mounting block 136 with an opening 138.

A front spring mounting support 140 is formed with a slot 142 for receiving the end of a spring 144 adapted to engage the nose (active area) of the rear magnetic head 108.

We provide the support 140 with an adjusting mechanism indicated generally by the reference character 146 similar to the adjusting mechanism 122 associated with the rear head support plate 116. We adjust the mechanisms 122 and 146 so that the spring 144 engages the nose of the head 108 with sufficient force to bring the note into contact with the head while at the same time permitting relatively free passage of a note between-the spring and the head. It will readily be seen that a note moving downwardly through the space between plates 42 and 52 is directed by knife edge 120 to between the spring 144 and the nose of head 108.

From the structure thus far described, it will be appreciated that the magnetic head 108 examines the rear face of any note passing between the plates 42 and 52. In order to examine the front face of a note passing through the space between plates 42 and 52, we provide a guide 148 and a spring 152 associated with the front magnetic head 106. In addition, we provide respective adjusting mechanisms similar to the mechanism 122 for the support plate carrying head 106 and guide 148 and for the support 150 for the spring 152.

Our apparatus includes note position sensors 152 and 154 for indicating when a note is so positioned that its magnetic characteristics should be sensed by the heads 106 and 108.

As is known in the art, the magnetic flux lines produced by the heads 106 and 108 extends only about 0.004" from the surface of the head. It is for that reason that we employ a means such as the springs 144 and 152 for urging the note into intimate contact with the heads 108 and 106. We have discovered that some other means than the springs 144 and 152 may be used to urge the notes into intimate contact with the heads. One such alternative is a foam rubber roller 156 which engages the head 108. A second alternative is a foam rubber belt 158 which engages the head 106. In any event, the means must be such as to so position the note relative to the head that magnetic material on the surface of the note facing the head is within 0.004" from the head.

Figure 5:
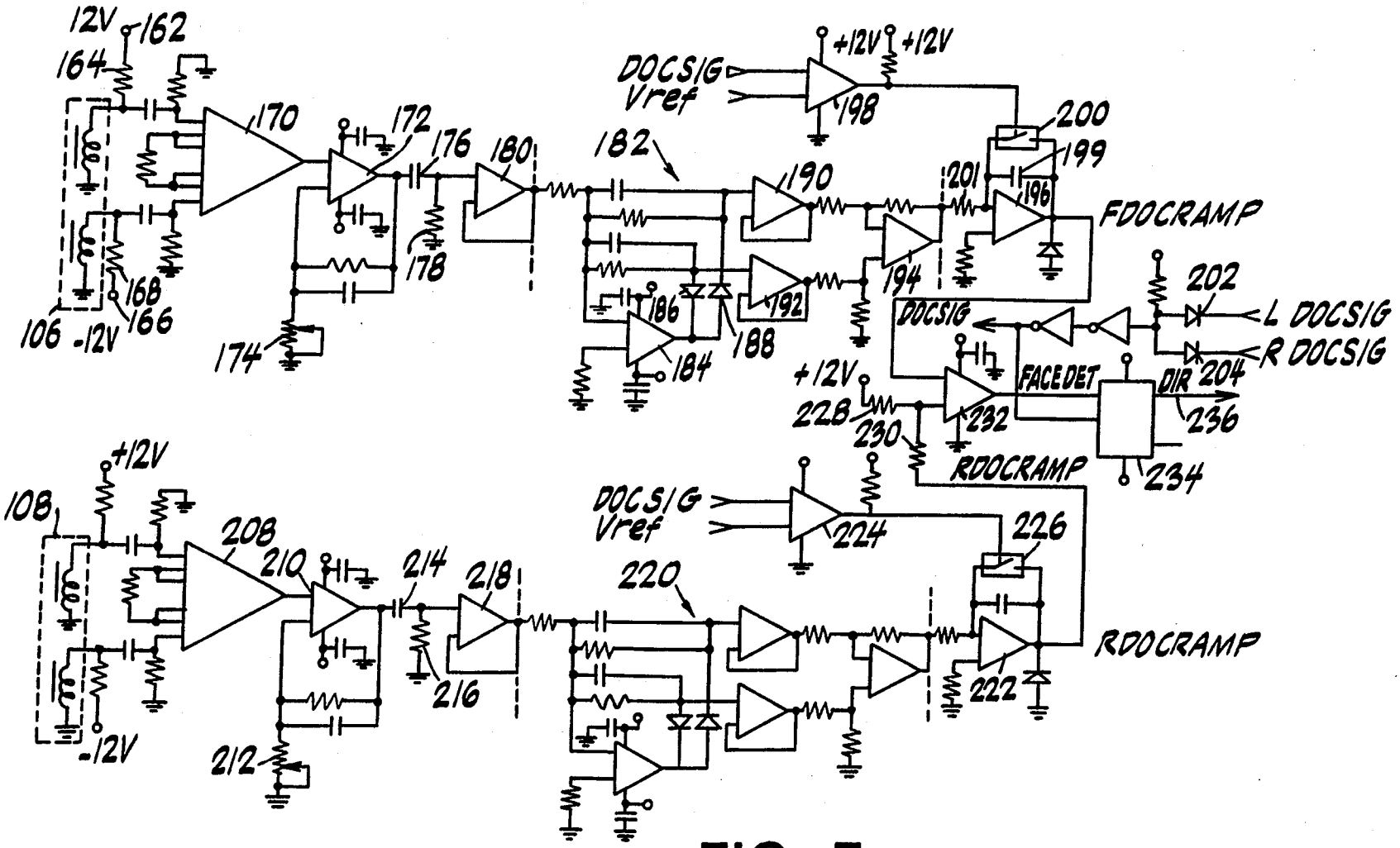
FIG. 5 is a schematic of one form of electrical circuitry which we may use in our magnetic facing system.

In making our measurement of the magnetic properties of the front and rear faces of a note, we measure the saturation magnetization of the dipoles in the ink on the note. Referring now to FIG. 5, which shows one form of electrical circuit which we may employ in our facing system, a resistor 164 connected between a terminal of +12 volts and one of the coils of the front head 106 passes a saturation current through that coil. A second resistor 168 connected between a terminal 166 of −12 volts passes a saturating current through the other coil of the head 106.

In response to magnetic material in the note face adjacent to the head 106, the reluctance of the flux path changes to cause the head to produce an output. An instrumentation amplifier 170 receives the head signals to feed an amplified signal to a second amplifier 172 provided with a gain control potentiometer which permits the gain of the amplifier 172 to be regulated.

A low pass filter made up of a capacitor 176 and resistor 178 couples the output of amplifier 172 to a voltage follower 180 which provides the input to an absolute value amplifier indicated generally by, the reference character 182 and located between the vertical broken lines of the upper branch of the circuit illustrated in FIG. 5. The amplifier 182 includes an amplifier 184, diodes 186 and 188 and voltage followers 190 and 192 associated with the respective diodes and providing inputs to a differential amplifier 194 to provide the output of the absolute value amplifier 182. In one embodiment of our circuit we select the amplifier 182 to have a gain equal to $-V_{in}$.

We apply the output of the amplifier 182 to a resettable integrator 196. The integrator 196 is controlled by an analog switch 200 in response to the output of a comparator 198. Comparator 198 in turn is responsive to a DOCSIG indicating the presence of a document as determined by sensors 152 and 154 and to a predetermined reference signal $V_{ref}$. The arrangement is such that the integrator 196 is operative so long as a document is present. When, however, there is no document present, as indicated by the absence of DOCSIG, the comparator 198 actuates switch 200 to short the capacitor 199 of the integrator 196 thus to reset the integrator. The integrator 196 Has an output of $$V_o(t) = -1/RC \int_O^{\tau} V_{in}\, \tau\, d\tau$$

where the RC time constant is the product of the values of resistor 201 and capacitor 199! . This output signal is identified as FDOCRAMP.

The structure just described in connection with the front head is duplicated for the rear head indicated by the reference character 206 in FIG. 5. The output of the rear head is fed to an instrumentation amplifier 208 which feeds an amplifier 210 provided with a gain control potentiometer 212. A low pass filter made up of a capacitor 214 and a resistor 216 feeds the output of amplifier 210 to a voltage follower 218 which supplies an absolute value amplifier 220. We feed the output of amplifier 220 to a resettable integrator 222 under the control of analog switch 226 and a differential amplifier 224. Integrator 222 provides an output signal identified as RDOCRAMP. We apply the output of integrator 222 to a voltage divider made up of a pair of resistors 228 and 230 connected between a terminal at +12 v and the output of integrator 222. A comparator 232 responsive to the voltage at the common terminal of resistors 228 and 230 and to the output of integrator 196 compares the two voltages to produce an output signal which actuates a D flip-flop 234 to provide a signal DIR on a line 236 for determining the direction in which the roller 72 is driven.

Our system is so arranged that if the signal DIR is high, the bill or note is facing the rear head 108. If the signal DIR is negative, then the bill is facing the front head 106. If the bill is facing the front head, the roller 72 may for example be driven in a counterclockwise direction as viewed in FIG. 1 to cause the bill to be delivered to the upper tray 86. If the bill is facing the rear head, roller 72 is driven in a clockwise direction to cause the bill to be delivered to the lower tray 94. When all the bills of an input stack have been examined, all of the bills facing the front head will be delivered to the upper tray while all of the bills facing the rear head will be delivered to the lower tray. The operator then merely takes the bills from the lower tray, inverts them and stacks them with the bills in the upper tray so that all of the bills in the input stack now are facing in the same direction.

The mechanical details of the gating roller 72 and its associated structure are shown and described in Winkler et al U.S. Pat. No. 4,420,153. The control of the direction of rotation of the gating roller in response to the directional signal DIR is described in Horvath et al U. S. Pat. No. 4,381,447. The disclosures of these two patents are incorporated herein by reference.

In operation of our facing system the picker roller 18 removes sheets one at a time from the bottom of a stack of sheets placed on the platform 16 and advances the notes or sheets to the nip between the feed rollers 20 and the strippers 22. Accelerating belts such as the belt 28 then advance the notes one at a time toward the path between the lower and upper guideplates 42 and 52. As soon as the presence of a note is sensed by either of the sensors 152 and 154, the analog switches 200 land 226 open to set the integrators 196 and 222 into operation. So long as either of the sensors 152 and 154 senses the presence of a document, both of the switches 200 and 226 remain open and the integrators 196 and 222 integrate the signals from the absolute value amplifiers 182 and 220. After the trailing edge of the note has passed both of the sensors 152 and 154, switches 200 and 226 close to reset the associated integrators 196 and 222.

In response to the signals from the integrators, comparator 232 puts out the FACEDET signal which indicates the disposition, either up or down, Of the face of a note which has been examined. In response to the FACEDET signal, the flip-flop 234 puts out the direction signal DIR to cause the gating roller 72 to feed the note to one or the other of the output trays 86 and 94 in accordance with the disposition, either up or down, of the face of a note which has been examined. When all of the notes Of the input stack have been examined and passed to the output trays, the operator takes the stack of notes from one output tray, inverts it and assembles it with the stack of notes from the other tray so that the faces of all of the notes are either up or down.

It will be seen that we have accomplished the objects of our invention. We have provided a system for arranging all of the notes of a plurality with the same side up. Our currency note facing system is simple in construction and in operation. It is reliable, Our system simultaneously tests the magnetic characteristics of both sides of a note under test. It directs notes fed face up to the testing area to a first output tray and notes fed face down to the testing area to a second output tray.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for facing the notes of an input stack each having respective sides one of which is a face printed with matter having a certain characteristic including in combination, means for moving notes from said input stack one by one along a note path, first means disposed along said path and at one side thereof for producing a first output signal as a measure of said characteristic of printed matter on said one side of a note moving along said path, second means disposed along said path and at the other side thereof for producing a second output signal as a measure of said characteristic of printed matter on the other side of said note moving along said path, and means for comparing said first and second signals to produce a facing signal indicative of the disposition of the face of said note moving along said path relative to the sides of said path.

2. Apparatus as in claim 1 including first and second output trays and means responsive to said facing signal for selectively directing notes to said first and second output trays in accordance with the disposition of the faces of said notes.

3. Apparatus as in claim 1 in which said certain characteristic is the magnetic character of the ink with which said notes are printed.

4. Apparatus as in claim 1 including means for sensing the presence of a note adjacent to said sensing means and means responsive to said sensing means for integrating said first and second output signals.

5. Apparatus as in claim 1 in which said certain characteristic is the magnetic character of the ink with which said notes are printed, each of said examining means comprising a magnetic head and means for urging a note moving along said path into contact with said head.

6. Apparatus for facing the notes of an input stack of notes, only one side of each of which is printed with ink having magnetic properties including in combination, means for moving notes from said input stack one by one along a note path extending through an examination location, a first magnetic detecting head at said examination location on one side of said path, first means for urging one side of a note moving along said path into intimate contact with said first head to cause the head to produce a first output signal in response to magnetic ink on said one side of said note, a second magnetic detecting head at said examination location on the other side of said path, second means for urging the other side of a note moving along said path into intimate contact with said second head to cause the head to produce a second output signal in response to magnetic ink on said other side of said note, detecting means for producing a note present signal in response to the presence of a note at said examination location, means responsive to said note present signal for integrating said first and second signals, and means responsive to said integrated first and second signals for producing a facing signal indicative of the disposition of the note side which is printed with magnetic ink relative to the sides of said path.

7. Apparatus as in claim 6 including first and second output trays and means responsive to said facing signal for directing notes selectively to said trays in accordance with the disposition of the note sides printed with magnetic ink.

8. Apparatus as in claim 7 in which said facing signal is positive for notes passing through said examination location with the side printed with magnetic ink adjacent to said first magnetic head and negative for notes passing through said examination location with the side printed with magnetic ink adjacent to said second magnetic head.

9. Apparatus as in claim 6 in which said urging means are metal springs.

10. Apparatus as in claim 6 in which said urging means are rollers formed of resilient material.

11. Apparatus as in claim 6 in which said urging means are belts formed of resilient material.

12. Apparatus as in claim 6 including respective inclined knife edge guides for directing notes to between said heads and said urging means.

13. Apparatus as in claim 6 including means for adjusting the force with which said urging means moves said note into engagement with said heads.

14. Apparatus as in claim 6 including a pair of guide plates defining said paths, said guide plates having windows at said examination location, respective mounting blocks carried by said plates at said windows, said mounting, means adjustably positioning said first head and said second urging means in the opening of one of said blocks and means adjustably positioning the second head and the first urging means in the opening of the other block.

15. A method for facing currency notes of an input stack of notes having only the face sides thereof printed with magnetic ink including the steps of moving the notes one by one along a path past an examination location, examining one side of a note moving along a path and from the corresponding one side of said path to produce a first signal representing the presence of magnetic ink on said one side of said note, examining the other side of said note moving along said path and from the corresponding other side of said path to produce a second signal representing the presence of magnetic ink on the other side of said note, and comparing said first and second signals to produce a facing signal indicative of the orientation of the face of a note toward one side or the other of said path.

16. A method as in claim 15 including the step of forming two stacks of notes in response to said facing signal.

17. A method as in claim 15 including the steps of producing a note present signal indicating the presence of a note at said location and integrating said first and second signals in response to said note present signal.

* * * * *